US009956128B1

(12) United States Patent
Phillips

(10) Patent No.: US 9,956,128 B1
(45) Date of Patent: May 1, 2018

(54) HOSPITAL BED, A METHOD FOR MOVING A PATIENT, AND A SYSTEM INCLUDING A DETACHABLE SANITARY STATION

(71) Applicant: C J Phillips, Danielsville, GA (US)

(72) Inventor: C J Phillips, Danielsville, GA (US)

( * ) Notice: Subject to any disclaimer, the term of this patent is extended or adjusted under 35 U.S.C. 154(b) by 0 days. days.

(21) Appl. No.: 15/791,598

(22) Filed: Oct. 24, 2017

(51) Int. Cl.

| | |
|---|---|
| ***A47B 13/00*** | (2006.01) |
| ***A61G 7/02*** | (2006.01) |
| ***A61G 9/00*** | (2006.01) |
| ***A61G 7/10*** | (2006.01) |
| ***A61G 7/018*** | (2006.01) |
| ***A61G 7/015*** | (2006.01) |
| *A61G 5/10* | (2006.01) |

(52) U.S. Cl.
CPC ..... *A61G 7/02* (2013.01); *A61G 7/015* (2013.01); *A61G 7/018* (2013.01); *A61G 7/1032* (2013.01); *A61G 9/003* (2013.01); *A61G 5/1002* (2013.01); *A61G 9/00* (2013.01); *A61G 9/006* (2013.01); *A61G 2203/16* (2013.01)

(58) Field of Classification Search
CPC .. A61G 7/1032; A61G 7/1034; A61G 7/1007; A61G 7/1009; A61G 7/1026; A61G 7/02; A61G 7/1002; A61G 7/015; A61G 7/018; A61G 9/003; A61G 2203/16; A61G 9/00; A61G 9/006; A61G 5/1002; A61G 7/047
See application file for complete search history.

(56) References Cited

U.S. PATENT DOCUMENTS

| | | | | |
|---|---|---|---|---|
| 1,793,006 A * | 2/1931 | O'Neill | ..... | A61G 7/1015 5/12.1 |
| 2,235,966 A * | 3/1941 | Summers | ..... | A47C 21/044 392/360 |
| 2,470,026 A * | 5/1949 | Freund | ..... | A61G 13/0009 5/602 |
| 3,388,406 A * | 6/1968 | Scrivener | ..... | A47C 21/028 5/488 |
| 3,612,509 A * | 10/1971 | Boston | ..... | A61G 7/1032 269/98 |
| 3,810,263 A * | 5/1974 | Taylor | ..... | A61G 7/1032 297/223 |

(Continued)

OTHER PUBLICATIONS

U.S. Appl. No. 15/791,624, filed Oct. 24, 2017, Phillips.

*Primary Examiner* — David E Sosnowski
*Assistant Examiner* — Morgan J McClure
(74) *Attorney, Agent, or Firm* — Mitch Harris, Atty at Law, LLC; Andrew M. Harris

(57) ABSTRACT

A hospital bed provides improved handling of non-ambulatory patients and others who cannot easily be moved, such as to a hospital room toilet. The hospital bed includes a flexible mattress and a belt attached to the flexible mattress ends. The hospital bed frame has a pallet for supporting the flexible mattress and a chute attached to the frame beneath the pallet that receives the end of the flexible mattress. Multiple rollers direct the flexible mattress and belt. A motor supplies rotational force to one of the rollers and one of the rollers also provides for bending the flexible mattress to enter the chute, so that the end of the flexible mattress is guided underneath the pallet. A system includes the hospital bed with a detachable sanitary station. The sanitary station includes a toilet top and unites with the bed to deliver the patient to a position atop the toilet.

14 Claims, 19 Drawing Sheets

(56) References Cited

U.S. PATENT DOCUMENTS 3,967,328 A * 7/1976 Cox ..... A61G 1/003 5/81.1 C
4,258,445 A * 3/1981 Zur ..... A61G 7/015 5/604
4,700,415 A * 10/1987 DiMatteo ..... A61G 5/006 297/DIG. 4
4,726,082 A * 2/1988 DiMatteo ..... A61G 7/1032 5/81.1 C
4,787,104 A * 11/1988 Grantham ..... A61G 7/00 5/423
4,819,283 A * 4/1989 DiMatteo ..... A61G 5/00 5/81.1 C
4,821,348 A * 4/1989 Pauna ..... A61G 7/0005 4/547
5,020,171 A * 6/1991 DiMatteo ..... A61G 7/053 5/81.1 C
5,127,113 A * 7/1992 Di Matteo ..... A61G 7/005 5/612
5,157,800 A * 10/1992 Borders ..... A61G 13/0009 5/602
5,390,379 A * 2/1995 Palmer, Jr. ..... A61G 7/053 5/81.1 C
5,469,588 A * 11/1995 DiMatteo ..... A61G 7/005 5/184
5,513,406 A * 5/1996 Foster ..... A61G 7/00 177/1
5,577,279 A * 11/1996 Foster ..... A61G 7/00 5/602
5,596,775 A * 1/1997 DiMatteo ..... A61G 7/001 297/335
5,680,661 A * 10/1997 Foster ..... A61G 7/0015 5/604
5,685,034 A * 11/1997 Kleer ..... A61G 7/02 5/604
5,806,114 A * 9/1998 Morgan ..... A61G 13/0009 5/602
6,058,533 A * 5/2000 Nelson ..... A61G 7/005 5/610
6,112,345 A 9/2000 Foster et al.
6,363,555 B1 * 4/2002 LaRose ..... A61G 7/1032 5/488
6,499,156 B1 * 12/2002 Dirst ..... A61G 7/1019 5/600
6,611,974 B2 * 9/2003 Roit ..... A61G 7/001 5/611
6,772,456 B2 * 8/2004 Votel ..... A61G 7/1019 5/81.1 HS
7,111,338 B2 * 9/2006 Faux ..... A61G 7/1019 5/81.1 C
7,337,478 B1 * 3/2008 Lake ..... A61G 7/1032 5/81.1 C
7,742,562 B2 * 6/2010 Weber ..... A61B 6/0457 378/209
8,336,134 B2 * 12/2012 Jelinek ..... A61G 7/015 5/83.1
8,336,138 B2 * 12/2012 Newkirk ..... A61M 5/1415 248/326
8,683,626 B1 * 4/2014 Kaczmarek ..... A61G 7/015 5/503.1
8,690,178 B2 * 4/2014 Griswold ..... A61G 5/10 280/250.1
8,745,779 B2 * 6/2014 Roberg ..... A61G 7/1026 5/81.1 C
9,149,401 B2 * 10/2015 Davenport ..... A61G 7/018
2002/0023297 A1 * 2/2002 Khait ..... A61G 7/0005 5/600
2012/0291196 A1 * 11/2012 Konda ..... A61G 7/1019 5/81.1 C
2014/0331406 A1 * 11/2014 Haider ..... A61G 7/08 5/600
2014/0357981 A1 * 12/2014 Dumoulin ..... A61B 5/0555 600/415

* cited by examiner

HOSPITAL BED, A METHOD FOR MOVING A PATIENT, AND A SYSTEM INCLUDING A DETACHABLE SANITARY STATION

BACKGROUND OF THE INVENTION

1. Field of the Invention

The present invention relates generally to medical equipment, and more particularly, to a hospital bed and hospital bed system having an integrated detachable sanitary station.

2. Description of the Related Art

Hospitals and other care facilities, in some cases including a disabled person's home, have a need for handling patients and persons with disabilities who may not have the ability to leave their bed, or who may have difficulty doing so. In particular, patient transfer is needed for permitting a patient to use a toilet and for subsequent cleaning needs. Hospital beds are available that can transfer a patient to the end of the bed and/or move a patient to different positions and such beds may also include removable panels for accessing a bedpan or other type of toilet seat. However, existing designs pose problems both with the movement of the mattress atop the bed, and with efficient handling of the toilet apparatus.

Therefore, it would be desirable to provide a hospital bed and hospital bed system having improved handling of the mattress during transport of a patient and efficient handling of cleaning and sanitary needs.

SUMMARY OF THE INVENTION

Efficient handling of patients and other disabled persons, including handling for cleaning and sanitary needs, is provided in a hospital bed, method and a system including a detachable sanitary station.

The hospital bed includes a flexible mattress, a belt having ends attached to the mattress at the mattress's first and second ends, a frame having a pallet for supporting the mattress and having legs extending to the floor, a chute attached to the frame beneath the pallet that receives the first end of the mattress, multiple rollers for directing the belt, and a motor for rotating one of the rollers in a direction of the first end of the mattress. The above arrangement provides that one of the ends of the mattress bends around one of the t rollers to enter the chute, so that the first end of the mattress is guided underneath the pallet to transport the patient to the end of the bed.

The system includes the hospital bed with the detachable sanitary station. The sanitary station includes a toilet top and unites with the bed to deliver the patient to a position atop a toilet. The sanitary station attaches to the end of the bed with a locking mechanism that may include a linear motor for drawing the sanitary station toward the end of the bed.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure shows devices and methods that move and support hospital patients to provide sanitary services at a hospital bed. The hospital bed provides a moving mattress that is flexible to bend under the foot of the bed and into a chute while moving the patient, and the sanitary station locks to the hospital bed while providing a toilet seat and cleaning facilities when the patient has been moved by the mattress to a position atop the toilet seat.

Figure 1:
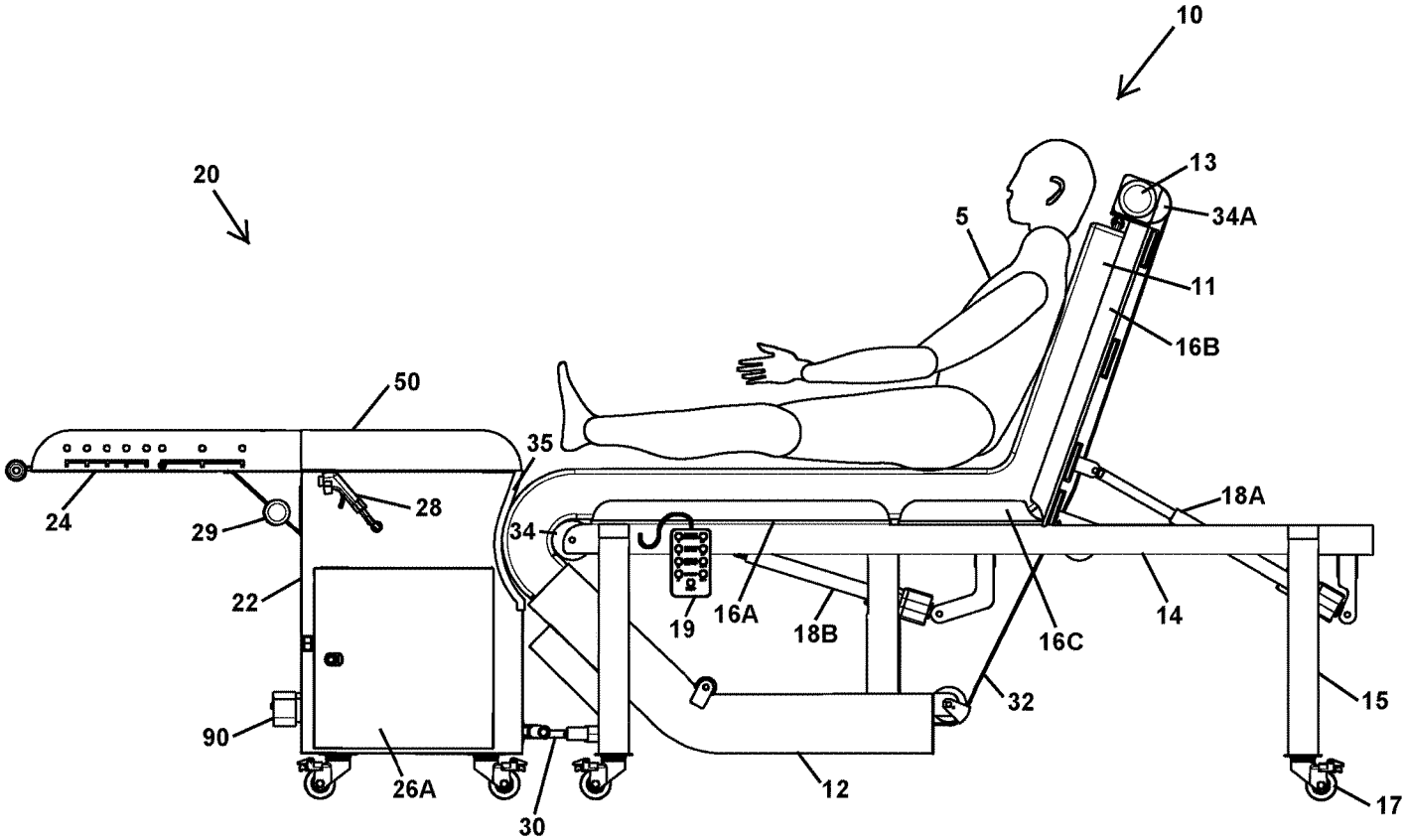
FIGS. 1-7 are side views showing an example of a sanitary station 20 and a hospital bed 10 performing a method as disclosed herein for moving and providing sanitation to a patient 5.

Referring now to FIG. 1, an exemplary sanitary station 20 is shown in a side view linked to an example hospital bed 10. FIGS. 1-7 demonstrate a method according to the disclosure for moving and providing sanitation to a patient 5. In FIG. 1, patient 5 is in a seated position, provided by activating a linear motor 18A to raise a pallet segment 16B until the desired angle of recline is reached. A mattress 11 supports patient 5 above a pallet provided by three pallet segments 16A-16C that hold mattress 11 above a frame 14 having legs 15 that extend downward to a set of rollers 17 that provide for moving hospital bed 10. Sanitary station 20 is linked to hospital bed 10 with a locking mechanism 30 that draws sanitary station 20 toward hospital bed 10 until mattress 11 protrudes into a curved recess 35 provided on the back of a cabinet 22 that supports a top 50 that includes a toilet seat (not shown). Top 50 is then positioned to extend over hospital bed 10, so that there is no vertical gap between hospital bed 10 and sanitary station 20. Sanitary station 20 also includes a water sprayer 28 for cleaning patient 5, a cabinet door 26A for accessing internals of sanitary station 20, a battery pack 90 for supplying power to sanitary station 20, as well as a pair of leg chutes 24 that guide and support the legs of patient 5 when patient 5 is moved over sanitary station 20. A locking bar 29 provides for raising and lowering leg chutes 24, so that the legs of patient 5 can be supported in a horizontal position or lowered to a vertical position. Mattress 11 is composed of a flexible foam pad that bends around a roller 34 and extends into a chute 12 having a rectangular cross-section slightly larger than that of mattress 11. A belt 32 having a width of approximately 2" to 4" is attached at the ends thereof to the head and foot of mattress 11 and returns through chute 12 to provide a complete loop along with mattress 11. Belt 32 is driven by a motor 13 that turns another roller 34A to move mattress 11 along pallet segments 16A-16C and into chute 12 to move patient 5 toward the foot of hospital bed 10 and onto sanitary station 20. A control pod 19 operates motor 13 as well as linear motor 18A and another linear motor 18B that is used to raise and lower pallet segment 16A in subsequent operations described below.

Figure 2:
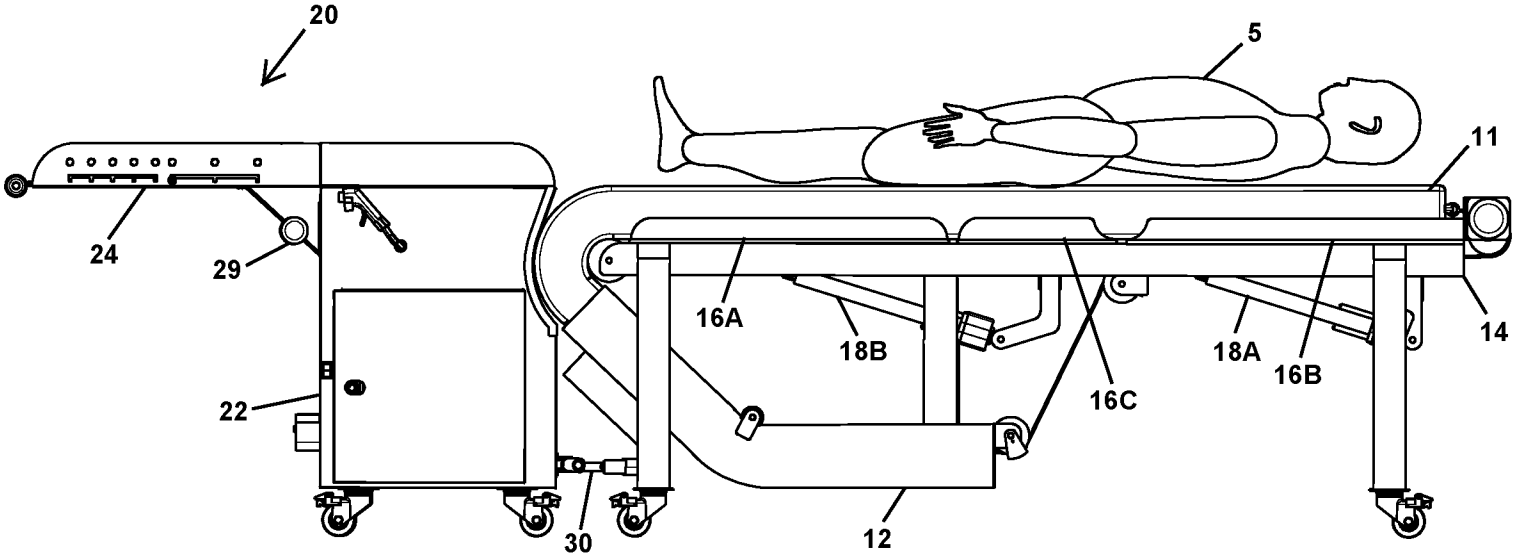
Figure 3:
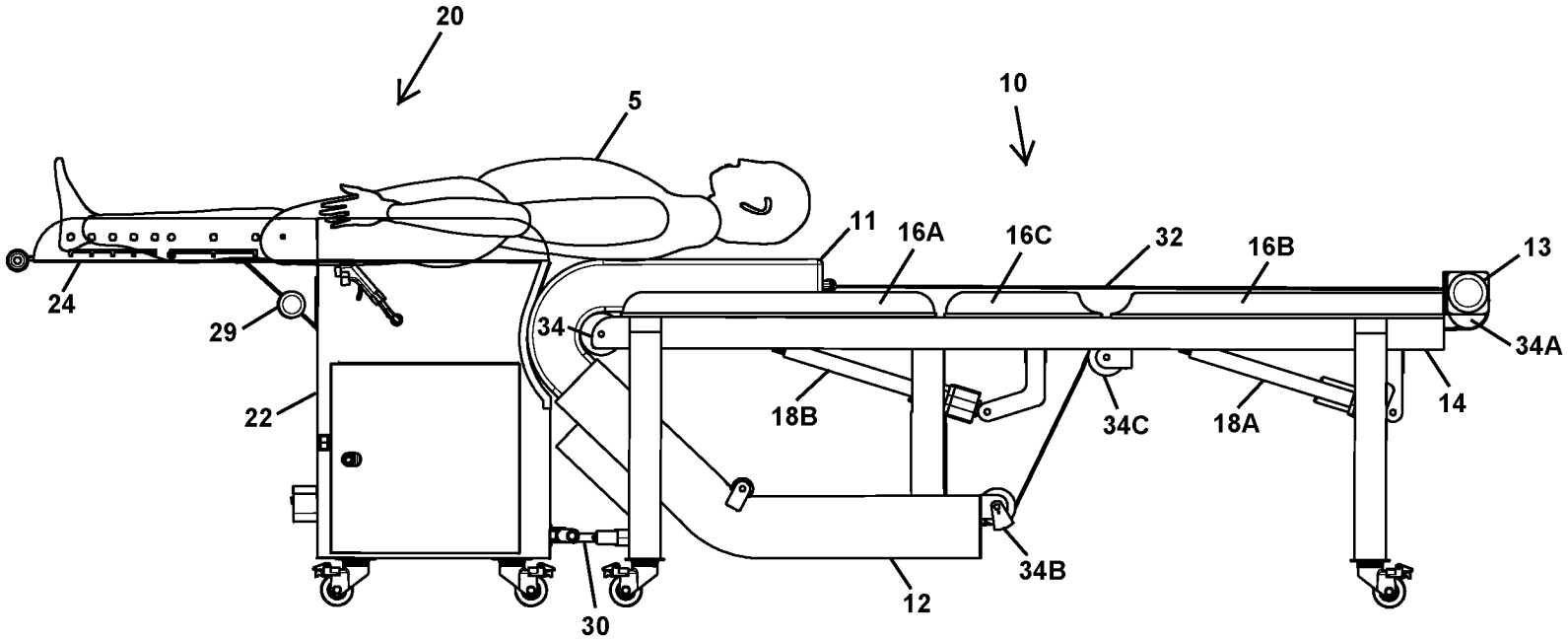
Figure 4:
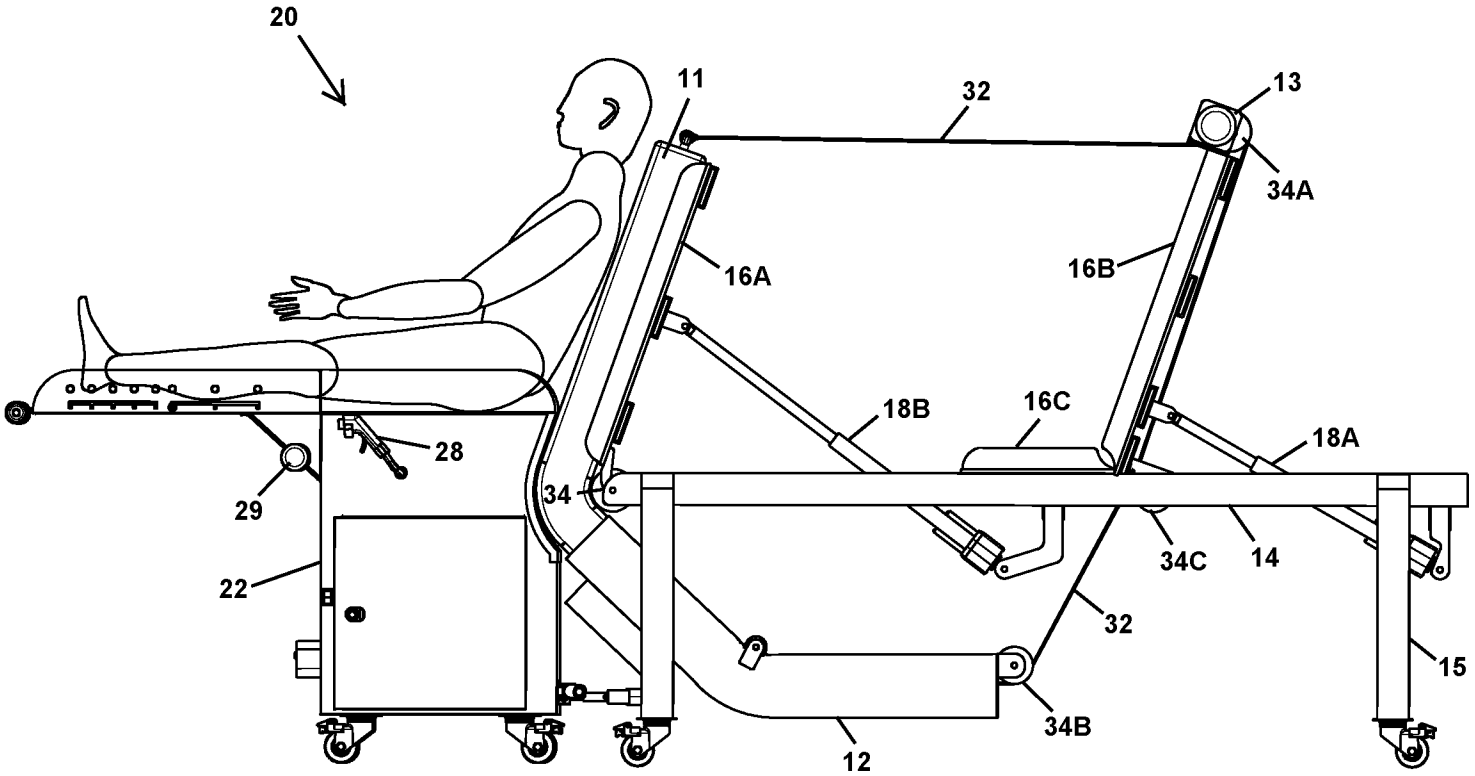
Figure 5:
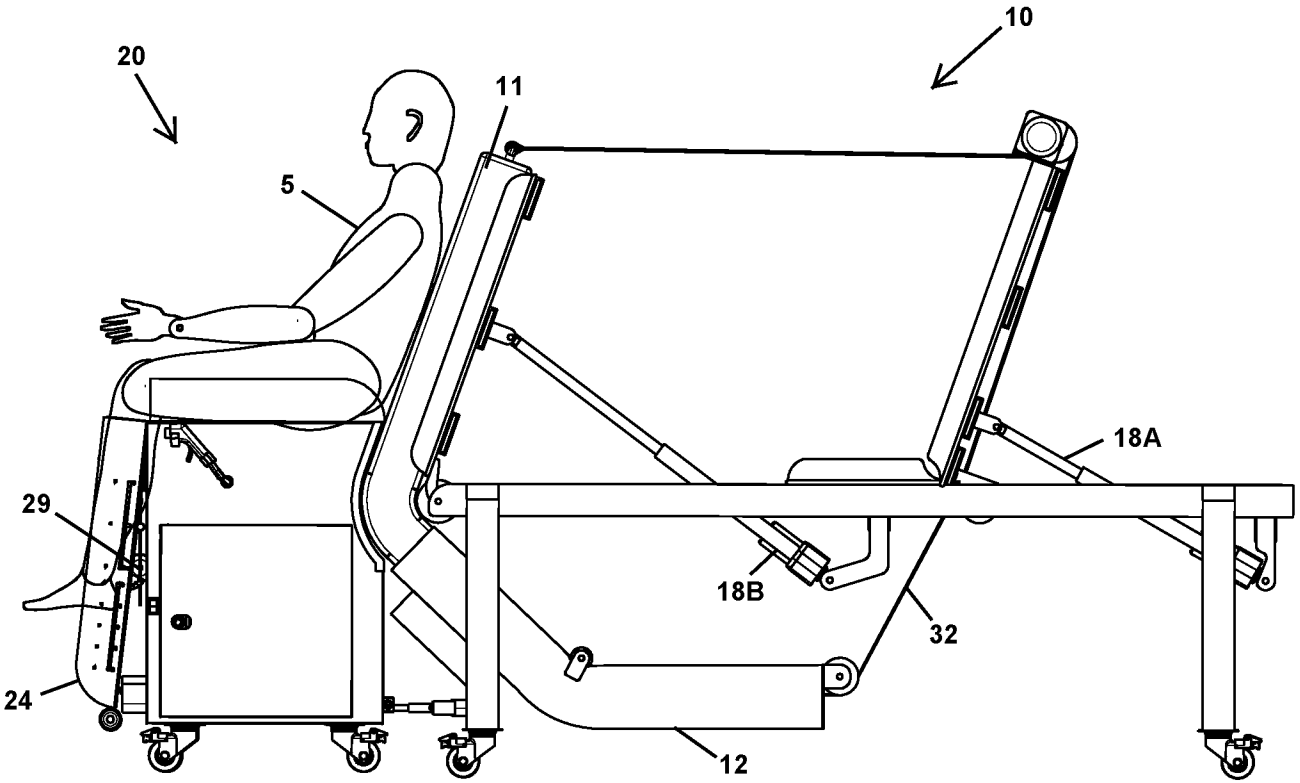
Figure 6:
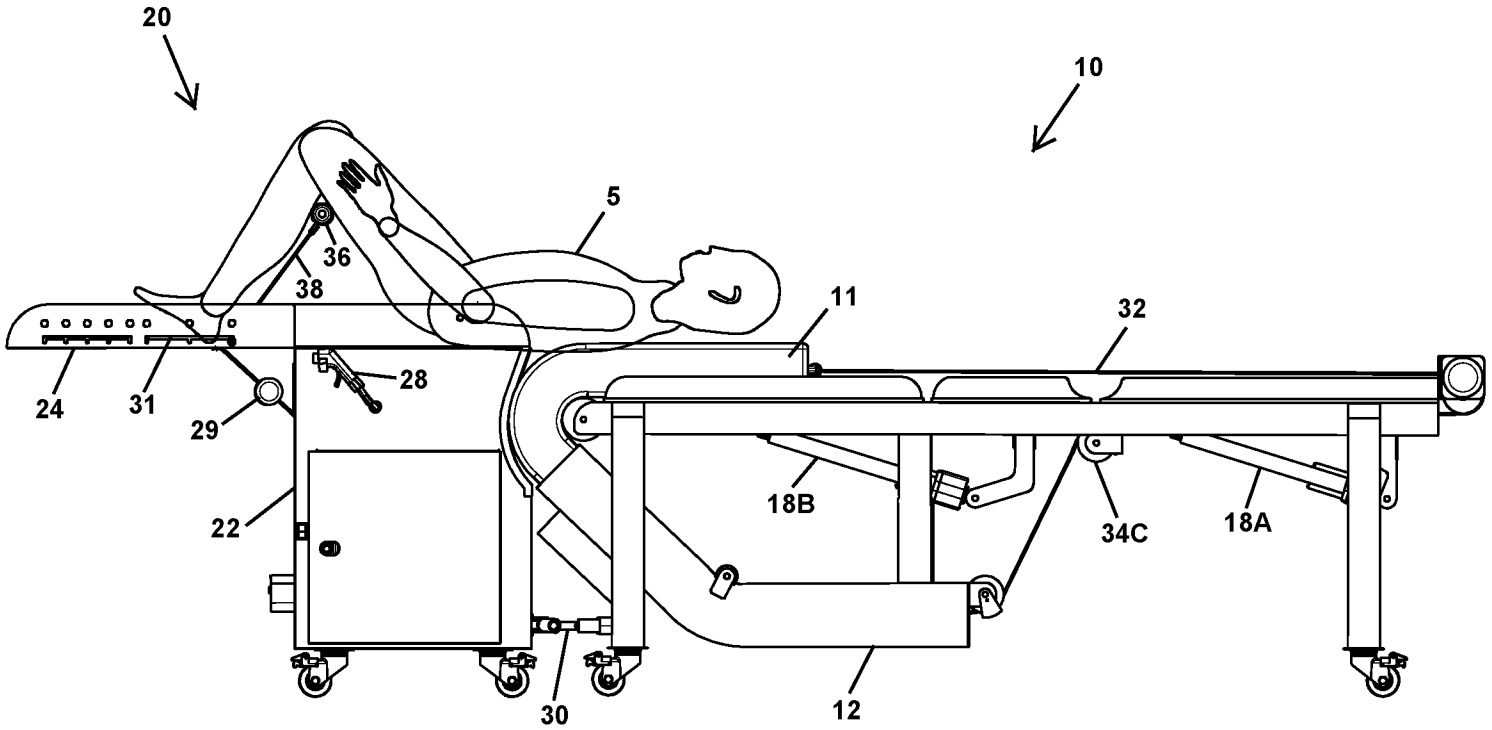
Figure 7:
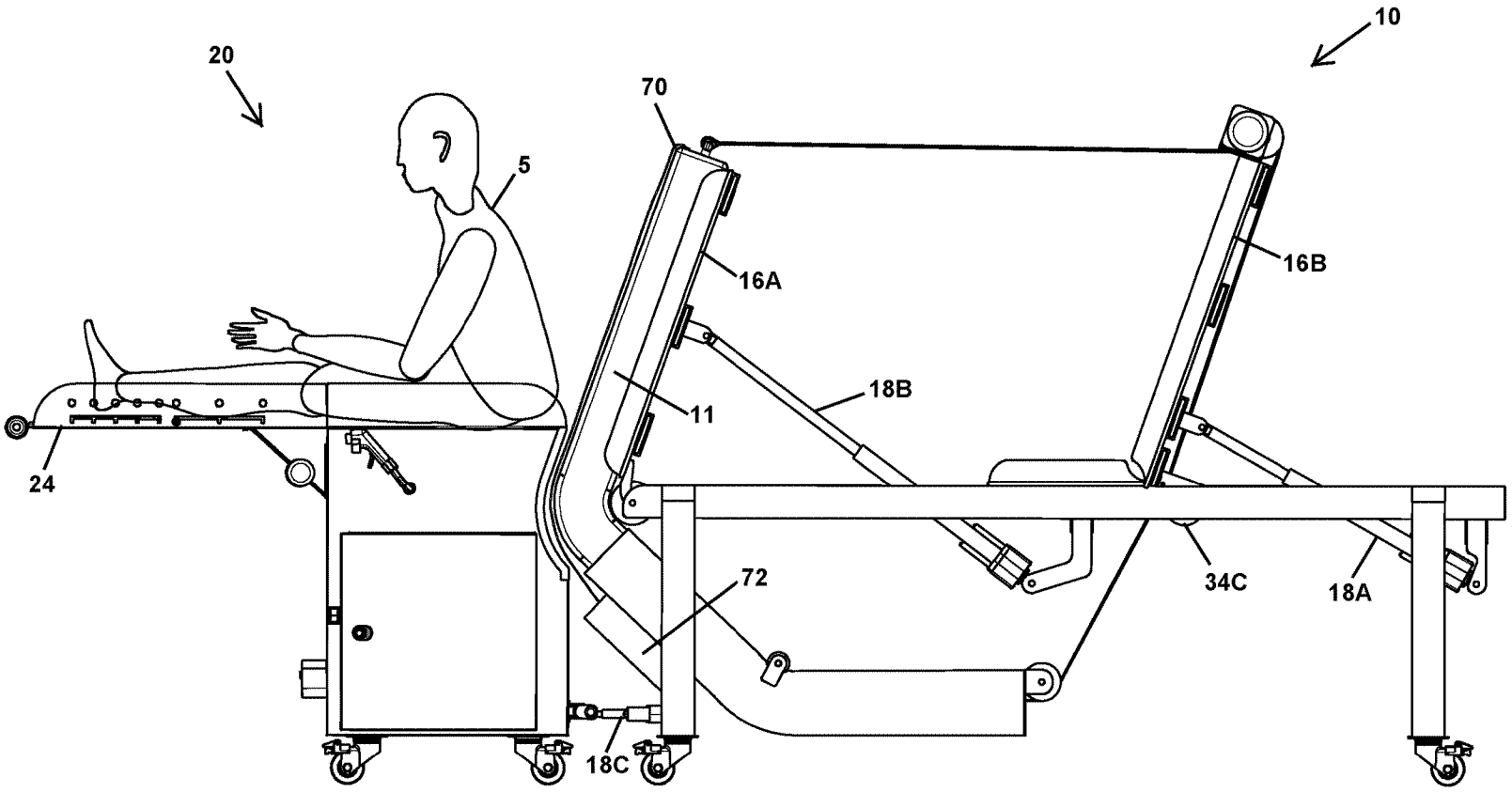

Referring now to FIGS. 2-7, a method of moving patient 5 onto and off of sanitary station 20 is shown. In FIG. 2, patient 5 is lowered to a supine position by activating linear motor 18A to lower pallet segment 16B. In FIG. 3, motor 13 is activated to rotate roller 34A which drives belt 32 to pull mattress 11 further into chute 12 and to move the head of mattress 11 off of pallet segments 16B and 16C and onto pallet segment 16A. Leg chutes 24 are locked in the horizontal position by locking bar 29 and guide the legs of patient 5, as patient 5 is moved atop sanitary station 20. In FIG. 4, pallet segment 16A is raised to support the back of patient 5 to return patient 5 to a seated position atop sanitary station 20 by activating linear motor 18B. The control of linear motor 18B and linear motor 18A is linked so that pallet segment 16B is raised in concert with pallet segment 16A, maintaining the length of the loop formed by mattress 11 and belt 32 so that additional slack and take-up mechanisms are not needed to provide relief when the head of mattress 11 is raised above frame 14. Some level of tensioning and relief is provided by a tensioning roller 34C that maintains belt 32 at a substantially constant tension as belt 32 is moved along roller 34A by motor 13 and another roller 34B located at the exit of chute 12. Pallet segment 16C is a fixed segment and may be used to provide rigidity to frame 14. In FIG. 5, leg chutes 24 are lowered by releasing locking bar 29 to permit patient 5 to sit atop the toilet seat (not shown) integrated in the top of sanitary station 20. In FIG. 6, leg chutes 24 are again locked in a horizontal position by locking bar 29, so that patient 5 can be cleaned. A set of knee supports 38 terminating in rollers 36 are moved under the backs of the knees of patient 5 by rolling rollers 36 along the undersides of the legs of patient 5 until the proper position is reached. A set of slots 31 is provided on each side of each of leg chutes 24 for adjustment of the position of knee supports 38. Sprayer 28 can then be pulled out to assist in cleaning patient 5. In FIG. 7, patient 5 has been lifted up by activating linear motor 18B to raise pallet segment 16A and has further leaned forward so that sanitary station 20 and hospital bed 10 can be separated by a few inches. A linear motor 18C forming part of locking mechanism 30 is activated to extend sanitary station 20 from the end of mattress 11, allowing replacement of bedding, such as an existing disposable sheet and/or bed pad. A disposable sheet 70 is extracted from a sheet holder 72 located beneath chute 12 and pulled upward to fasten disposable sheet 70 at the head of mattress 11, such as by providing hook-and-loop fasteners on disposable sheet 70 and at the head of mattress 11. Moving patient 5 back to a resting position is performed by drawing sanitary station 20 back to join hospital bed 10 by activating linear motor 18C, and then repeating the steps shown in FIGS. 2-5 or FIGS. 1-5 in reverse order.

Figure 8:
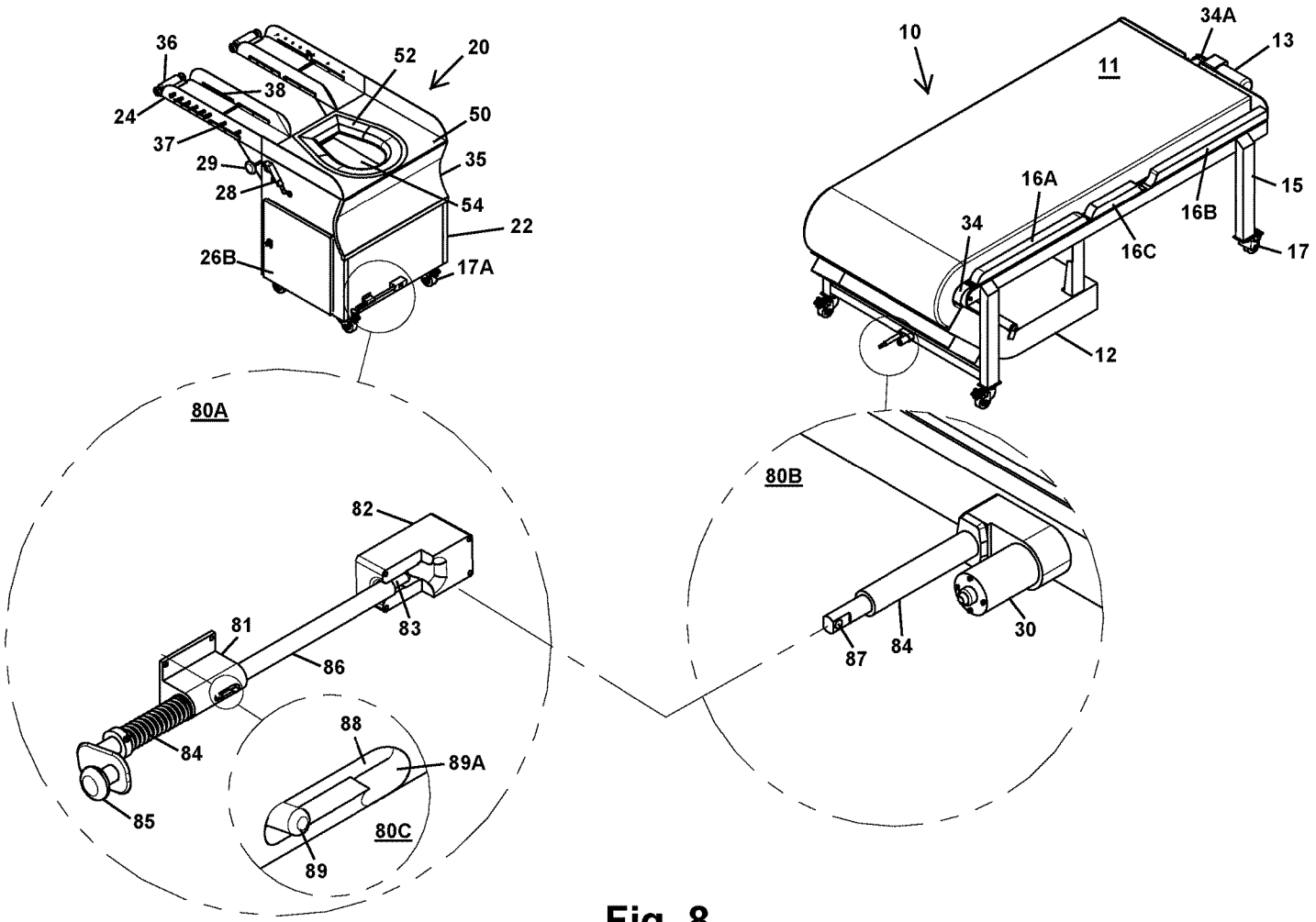
FIG. 8 is a perspective view showing details of an interconnect between sanitary station 20 and hospital bed 10 of FIGS. 1-7.

Referring now to FIG. 8, a perspective view showing details of an example interconnect between sanitary station 20 and hospital bed 10 of FIGS. 1-7 is shown. Detail callout 80A shows the portion of locking mechanism 30 in FIG. 1 that is installed on sanitary station 20, which comprises a rod 86 that is guided by a mount 81 and terminates in a locking pin 83 at a first end and a knob 85 at a second end. The first end of rod 86 enters a guiding port 82 that accepts an end 87 of a counterpart of locking mechanism 30 mounted on hospital bed 10 as shown in detail callout 80B, and that extends from a linear motor 84 that is activated in one direction or the other to draw sanitary station 20 and hospital bed 10 together or apart. Detail callout 80C shows a pin 89 that travels along a slot 89 that is shaped to include a recess 89A in which pin 89 can be secured by turning knob 85 to lock sanitary station 20 and hospital bed 10 together, by holding locking pin 83 within a corresponding hole at the end 87 of linear motor 84.

FIG. 8 also shows further details of sanitary station 20, which is movably supported on a set of rollers 17A. The shape of curved recess 35 can be seen and forms a semi-cylindrical indentation in the back side of cabinet 22. A removable pan 54 lies beneath a toilet seat 52 and top 50 of cabinet 22. Spring-loaded pull pins 37 provide adjustment of the position of knee support 38 and a number of slots are provided in the side wall of leg chute 24, so that the position at which the end of knee support 38 is pinned to forming a hinge connection to leg chute 24 is adjustable, along with the position of knee support 38 between pull pins 37, which adjust the final upward and lateral position of roller 34. An additional set of pull pins and slots are provided toward the foot of leg chute 24 for attaching and adjusting a pair of foot support plates (not shown).

Figure 9B:
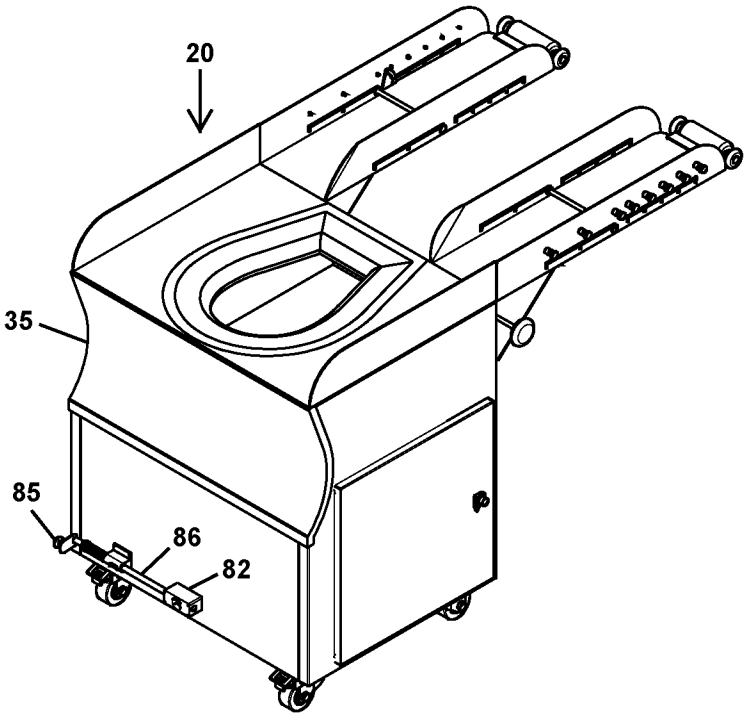
FIG. 9A and FIG. 9B are back right and front left perspective views, respectively, of sanitary station 20 of FIGS. 1-7
Figure 9A:
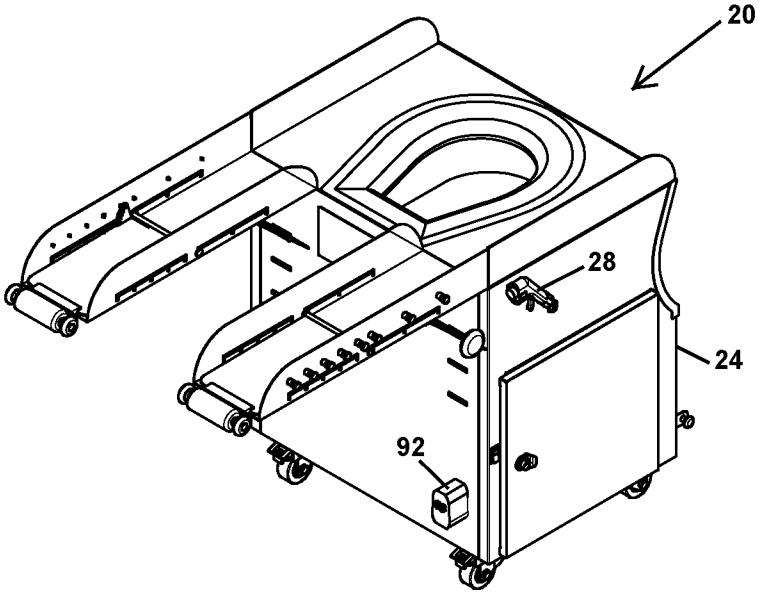
Figure 9C:
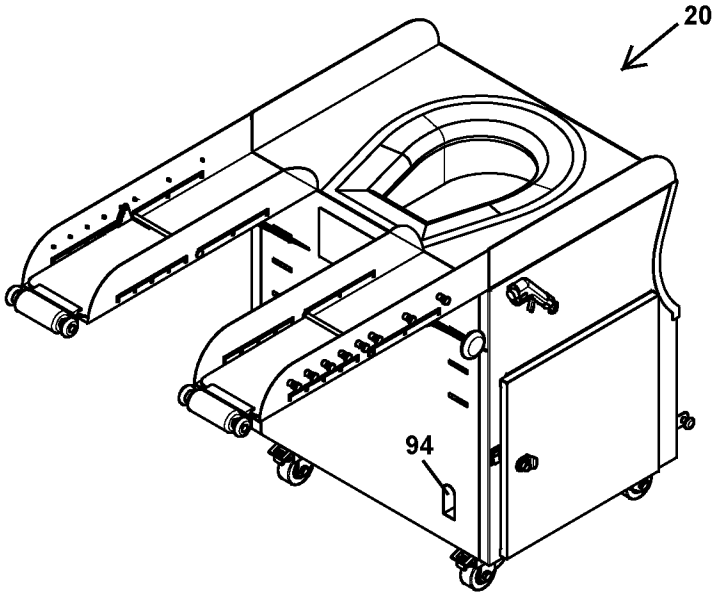
FIG. 9C is a back right perspective view of sanitary station 20 with a battery pack 92 removed.

Referring now to FIGS. 9A-9C perspective views of sanitary station 20 are shown, illustrating further details of sanitary station 20. In FIG. 9A a rechargeable battery pack is shown installed against the back wall of cabinet 22 and FIG. 9C shows a connector 94 that receives battery pack 92 with battery pack 92 removed.

Figure 10:
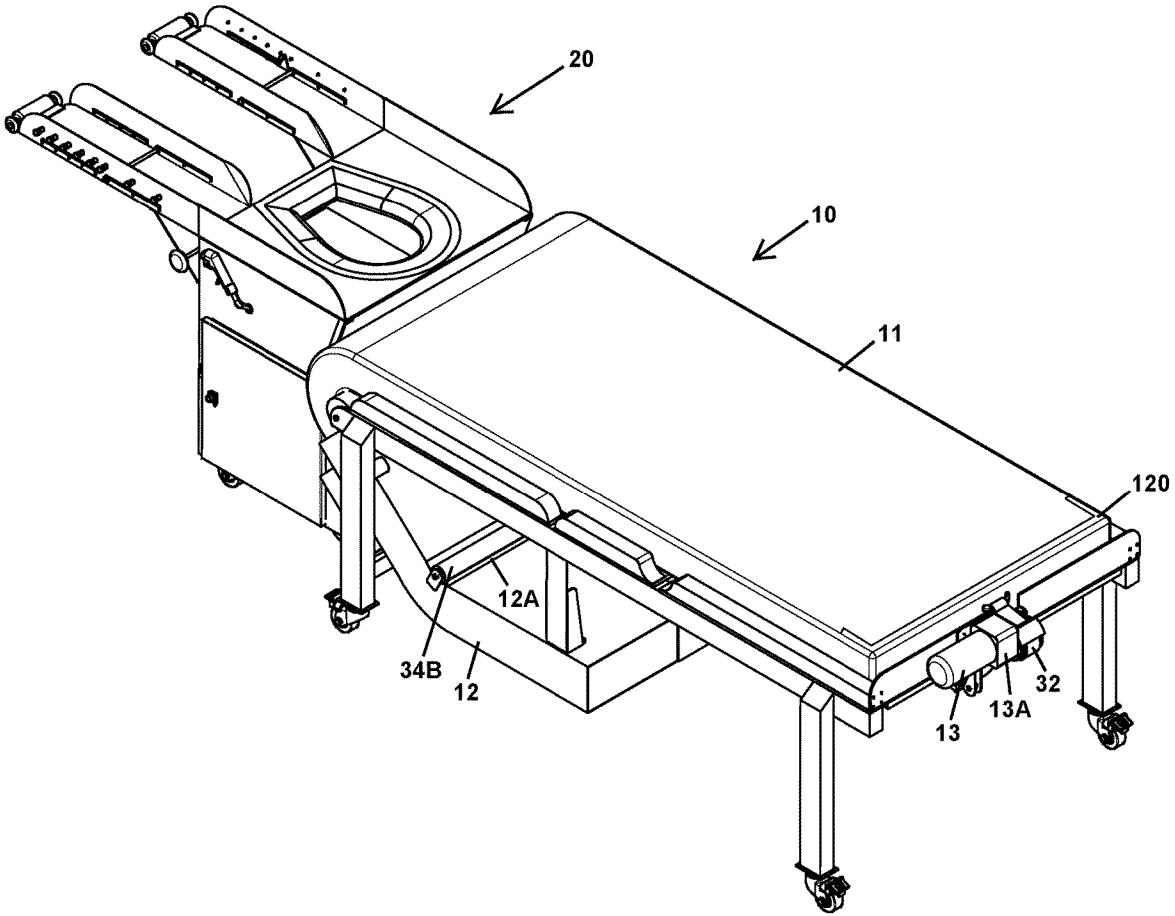
FIG. 10 and FIG. 11 are a back left perspective view and a left side view, respectively, of sanitary station 20 and hospital bed 10 locked together.
Figure 11:
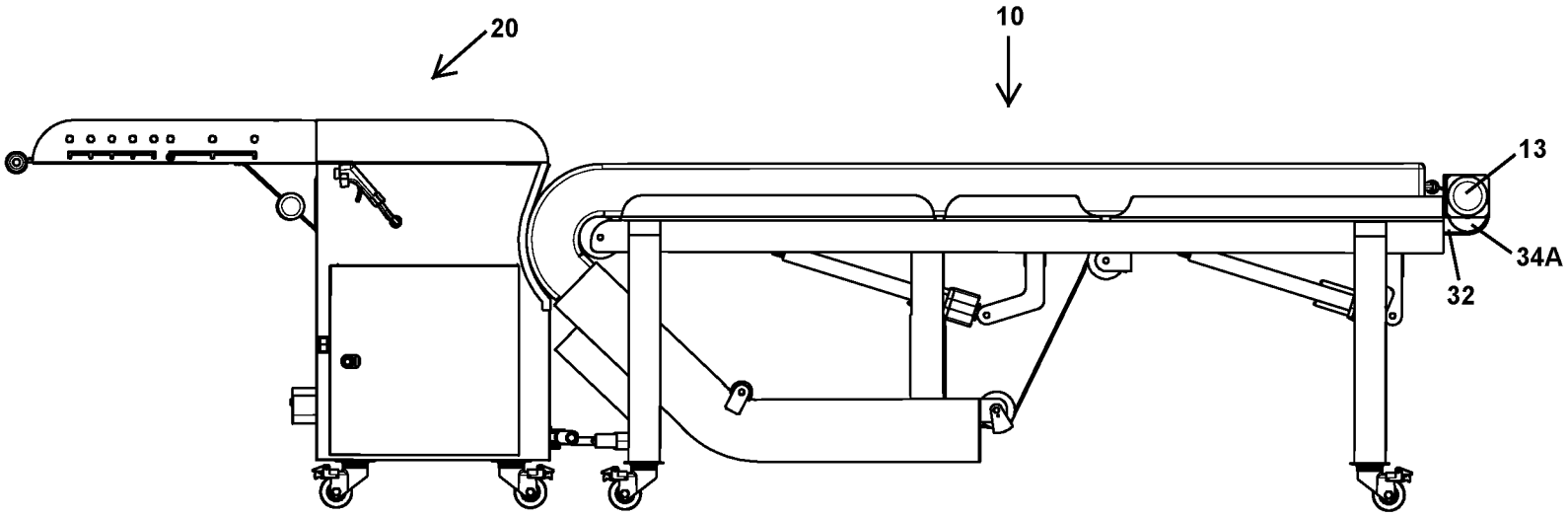

Referring now to FIG. 10 and FIG. 11 a back left perspective view and a left side view, respectively, of sanitary station 20 and hospital bed 10 locked together show further details of hospital bed 10. At each end of mattress 11, a plastic frame 120 is provided that is used to stabilize the ends of mattress 11 so that tension can be applied from belt 32 across the end of mattress 11 without distortion. One or more metal rods or other reinforcement may be embedded within or behind plastic frame 120 to provide a linkage to which belt 32 is connected within the end of mattress 11. Plastic frame 120 may be, for example, a ¾" plate made from polyvinyl acetate or other suitable acrylic having sufficient stiffness and having a profile matching a thickness and width of mattress 11. Motor 13 includes a gearbox 13A that provides for reducing the rotation rate provided by motor 13 and increasing the torque applied to belt 32. Belt 32 may include a gearing pattern formed on a portion of the length of belt 32 expected to travel along roller 34 and roller 34A may include a complementary tooth pattern, to eliminate slip between belt 32 and roller 34A. Roller 34B extends through a slot 12A provided in chute 12 to permit roller 34B to contact portions of mattress 11 that extend within chute 12 to roller 34B and to contact belt 32 when mattress 11 does not extend into chute 12 or when the portion of mattress 11 within chute does not extend to roller 34B.

Figure 12B:
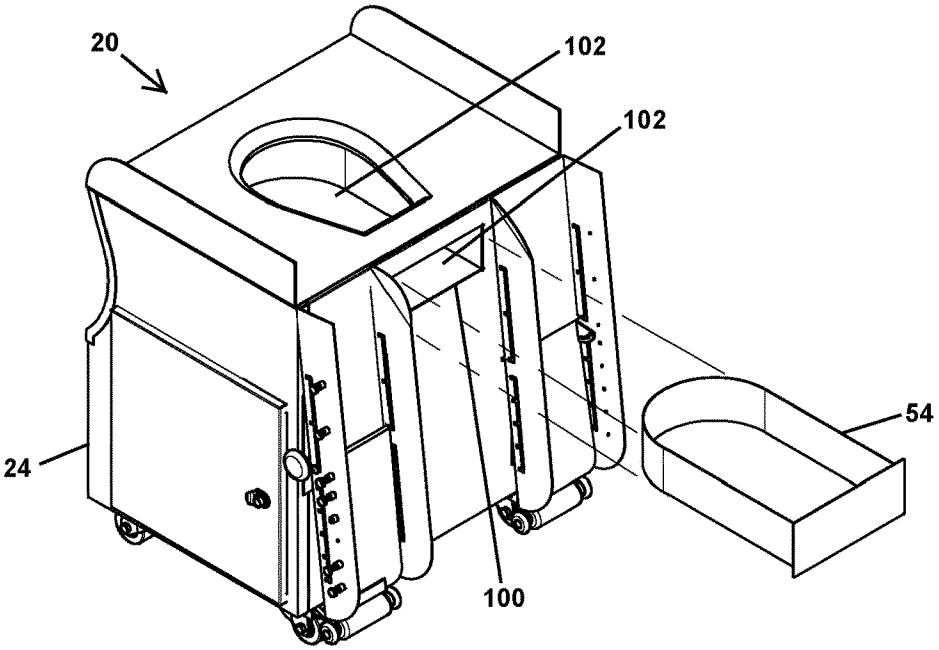
FIG. 12A and FIG. 12B are back left perspective views of sanitary station 20.
Figure 12A:
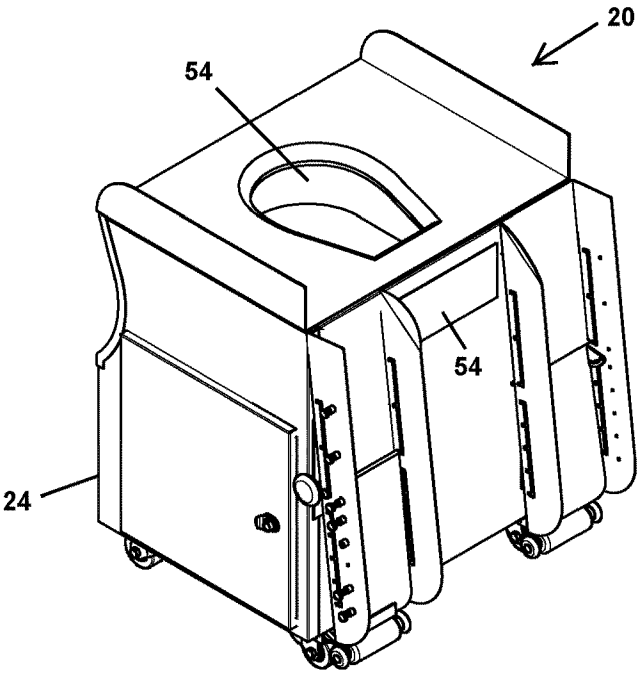

FIG. 12A and FIG. 12B are back left perspective views of sanitary station 20 showing the operation of removable pan 54 that is slid through a corresponding aperture 100 within cabinet 22. In FIG. 12A, removable pan 54 is installed in a sealed recess 102 within cabinet 22 and in FIG. 12B, removable pan 54 is installed within sealed recess 102.

Figure 12D:
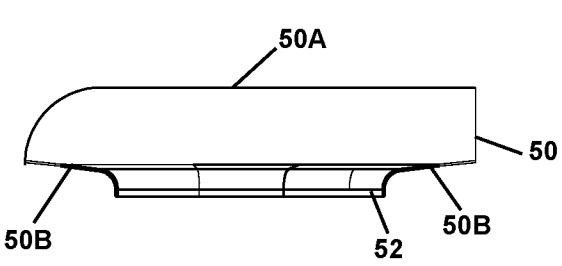
FIGS. 12C-12F are cross-section views of a top 50 of sanitary station 20.
Figure 12F:
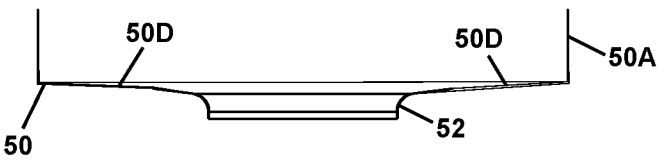
Figure 12C:
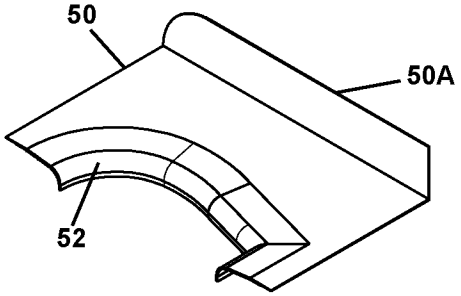
Figure 12E:
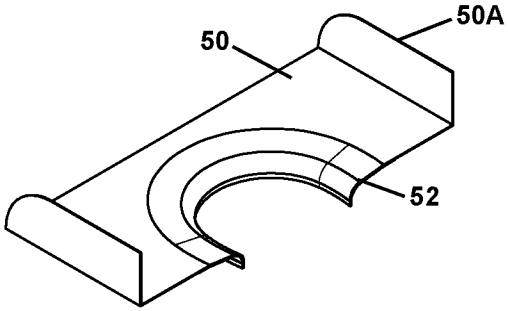

Referring now to FIGS. 12C-12F, cross-section views of top 50 of sanitary station 20 are shown. FIG. 12C shows a perspective view of a front-to-back cross-section of top 50 and toilet seat 52, showing sides 50A and FIG. 12D is a side cross section view showing inclined portions 50B of top 50 extending downward with approximately a 20-25% slope to the curvature of toilet seat 52, which in the example is formed within top 50 e.g., out of stamped/bent stainless steel. FIG. 12E shows a perspective view of a side-to-side cross-section of top 50 and toilet seat 52, showing sides 50A and FIG. 12F is a front cross section view showing inclined portions 50D of top 50 extending downward with approximately a 10-15% slope to the curvature of toilet seat 52. The sloped top 50 of sanitary station 20 ensures fluid waste will travel to toilet seat 52 and into removable pan 54 and also ensures that water used for cleaning will also end up in removable pan 54.

Figure 13:
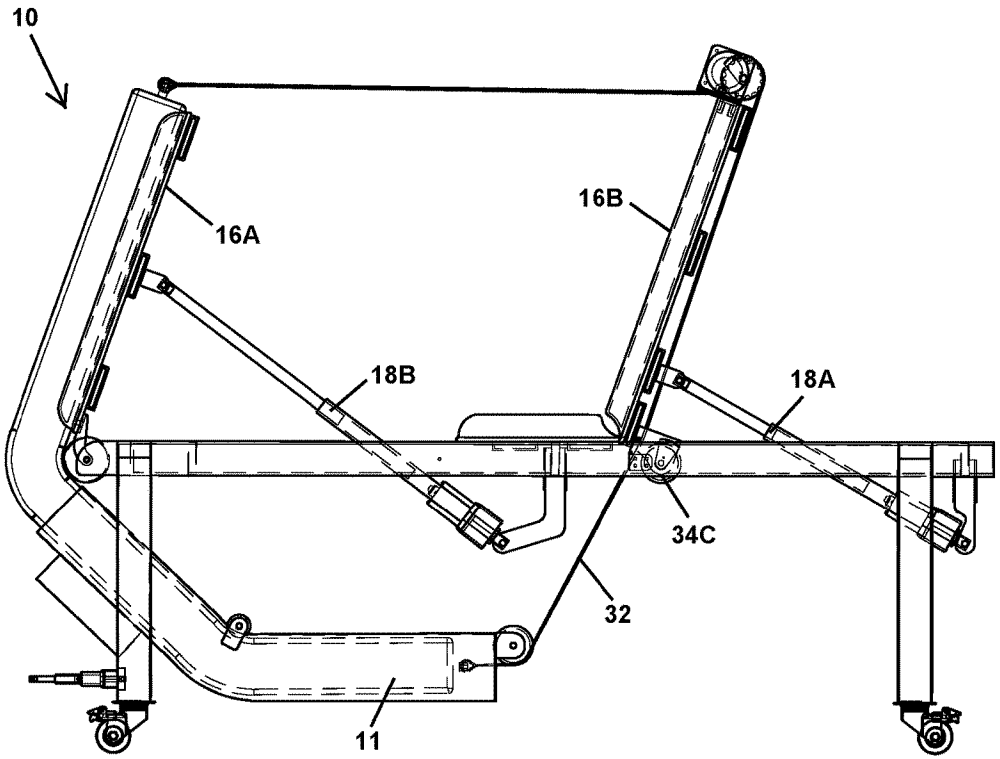
FIG. 13 is a side view of hospital bed 10 in a configuration for supporting a patient atop an attached sanitary station 20 or for lifting a patient to a standing position.
Figure 14:
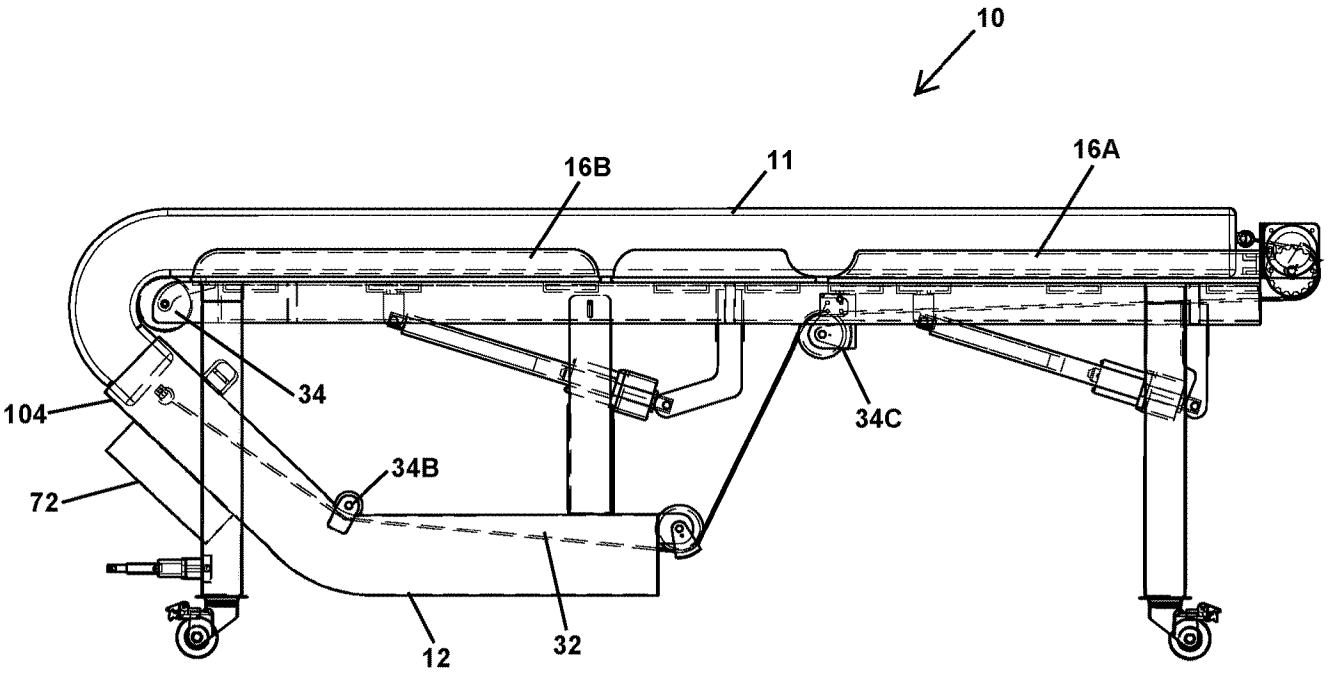
FIG. 14 is a side view of hospital bed 10 in a configuration for supporting a patient in a supine resting position.

Referring now to FIG. 13 and FIG. 14, side views of hospital bed 10 shows further details of hospital bed 10. FIG. 13 shows hospital bed 10 in a configuration for supporting a patient atop an attached sanitary station or for lifting a patient to a standing position. Mattress 11 is drawn by belt 32 to substantially the full extent of chute 12 and details of tension roller 34C, which is generally a spring-loaded adjustable tensioner are visible. Tension roller 34C is relaxed and not in contact with belt 32 in the depicted position of pallet segment 16B and linear motor 18A, as mattress 11 is not moved while either of pallet segments 16A and 16B are raised. FIG. 14 shows hospital bed 10 in a configuration for supporting patient 5 lying on hospital bed 10. Mattress 11 is in the other extreme of position with respect to FIG. 13, since the head of mattress 11 is substantially at the head of hospital bed 10. Tension roller 34C is engaged and mattress 11 extends only slightly into chute 12, so that the complete bend around roller 34 is provided and belt 32 extends through chute 12 and contacts roller 34B. Belt 32 does not ever exit the end of chute 12 through which mattress 11 extends, so that the thickness and width of mattress 11 remain properly positioned with respect to an entrance 104 of chute 12. The position of sheet holder 72 can also be seen in further detail as mounted on the bottom side of chute 12 near entrance 104.

Figure 15:
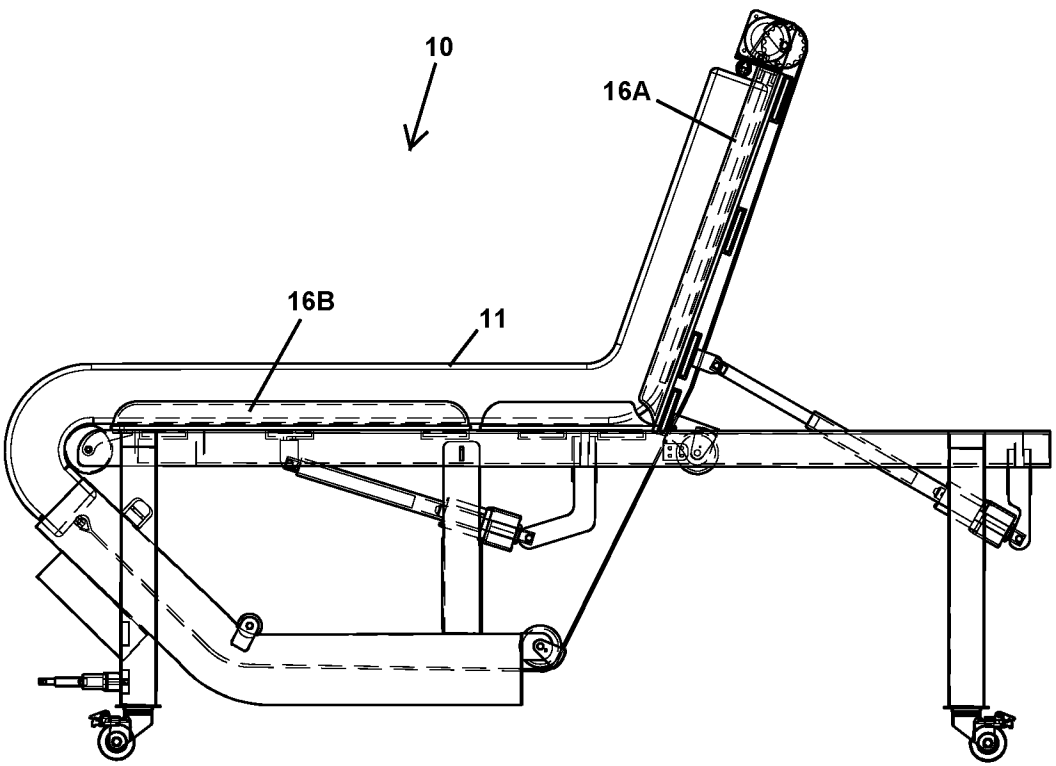
FIG. 15 is a side view of hospital bed 10 in a configuration for supporting a patient in a seated position in hospital bed 10.

FIG. 15 is a side view showing details of hospital bed 10 in a configuration for supporting a patient in a seated position in hospital bed 10. The position of mattress 11 with respect to chute 12 and pallet segments 16A,16B is identical to that of FIG. 14. Tension roller 34C is disengaged and mattress 11 will not be moved in the depicted configuration with pallet segment 16A raised and linear motor 18B extended.

Figure 16:
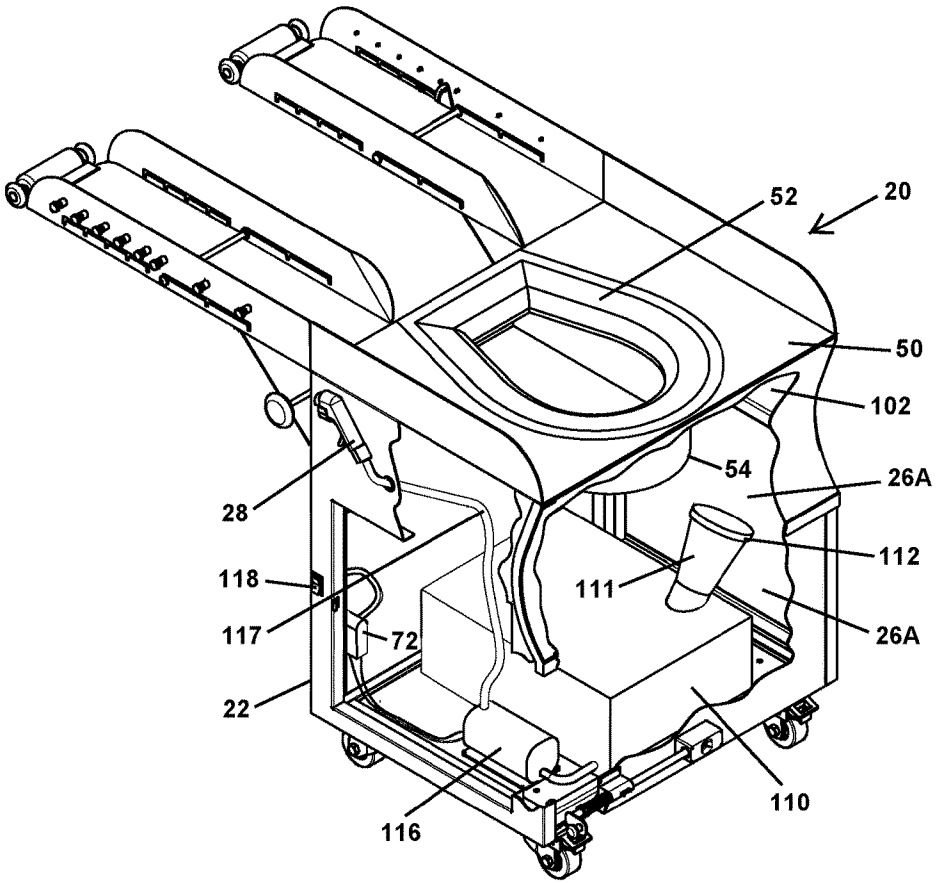
FIG. 16 is a perspective view of sanitary station 20, showing internal details thereof.

FIG. 16 is a perspective view of sanitary station 20, showing internal details thereof. Sealed recess 102 has been opened to show the bottom of removable pan 54. A water tank 110 is Tillable via a funnel 111 spout, shown with a removable cap 112 installed. Water tank 110 supplies water to a pump 116, which, when activated, supplies pressurized water to sprayer 28 through a hose 117 that retracts into cabinet 22 when sprayer 28 is not in use. Battery pack 92 is visible and is coupled in series with a switch 118 and pump 116 to activate the supply of water to sprayer 28.

Figure 17:
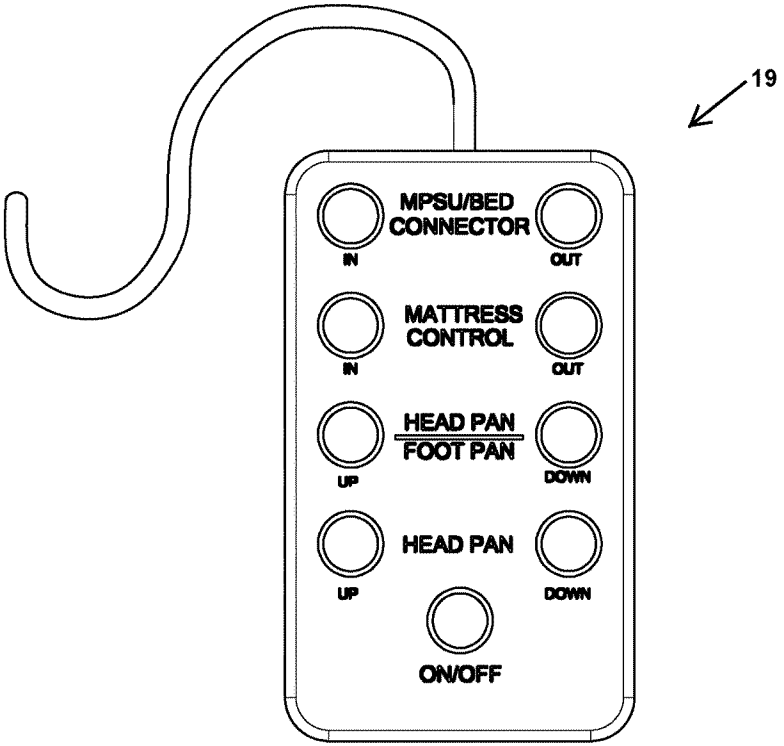
FIG. 17 is a front view showing details of a control pod 19 of FIG. 1.

FIG. 17 is a front view showing details of control pod 19 of FIG. 1. While pump 116 described above is operated by a battery 90 inserted in battery pack 92, power to motor 13 is provided separately and is generally supplied from either isolated AC mains or an isolated DC power supply. Similarly, linear motors 18A-18C can be DC operated, or operated from isolated AC mains. Control pod 19 may operate relays located at motor 13 and at linear motors 18A-18C, or may provide switches directly controlling current supplied to motor 13 and linear motors 18A-18C. The left set of buttons supply a first polarity/phase to corresponding ones of motor 13 and linear motors 18A-18C and the right buttons supply a second polarity/phase to the corresponding motor (s), so that directions of "in" vs. "out" and "up" vs. "down" are controlled by control pod 19. The first row of switches labeled MPSU/Bed connector operates linear motor 18C to move sanitary unit 20 and hospital bed 10 together (in) or apart (out), i.e., to transition between the positions of hospital bed 10 and sanitary station 20 shown in FIGS. 6 and 7. The next row of switches labeled mattress control operates motor 13 to move mattress 11 into or out of chute 12, i.e., to transition between the positions of hospital bed 10 shown in FIGS. 2 and 3. The third row of switches labeled "head pan/foot pan" operates linear motors 18A and 18B in concert to raise and lower pallet segments 16A and 16B in parallel, i.e., to transition between the positions of hospital bed 10 shown in FIGS. 3 and 4. The last row of switches labeled "head pan" operates only linear motor 18A to raise and lower pallet segment 16A, i.e., to transition between the positions of hospital bed 10 shown in FIGS. 1 and 2.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A hospital bed for supporting and moving a patient, comprising:

a flexible mattress;

a belt having a first end attached to the flexible mattress at a foot of the flexible mattress and a second end attached to a head of the flexible mattress;

a frame having a pallet for supporting the flexible mattress and having legs extending to the floor, wherein the pallet comprises a first segment extending from a head of the hospital bed that, when the head of the flexible mattress is positioned at the head of the hospital bed, rotates to raise a back of the patient to a first seated position atop the hospital bed and lowers the back of the patient to a supine position and a second segment that, when the foot of the flexible mattress is positioned within the chute and the head of the flexible mattress is positioned on the second segment, rotates to raise a back of the patient while the patient is seated on the movable sanitary station positioned at the foot of the hospital bed;

a chute attached to the frame and disposed beneath the pallet for receiving the foot of the flexible mattress;

multiple rollers for directing the belt, including a first roller positioned at a first end of the frame corresponding to a foot of the hospital bed for bending the flexible mattress around the first end of the frame and downward into the chute, and a second roller positioned at a second end of the frame over which the belt travels when the head of the flexible mattress is moved toward the first end of the frame, whereby the foot of the flexible mattress is guided underneath the pallet and the head of the flexible mattress is moved toward the first end of the frame to transport the patient to the foot of the hospital bed;

a motor for rotating one of the multiple rollers to move the flexible mattress and the belt;

a first linear motor for raising and lowering the first segment of the pallet;

a second linear motor for raising and lowering the second segment of the pallet; and a control pod for controlling activation of the first linear motor and the second linear motor, wherein the control pod includes an activator for activating the first linear motor and the second linear motor to raise both the first segment and the second segment of the pallet in concert, so that a length of extension of the belt between the second end of the belt at the head of the flexible mattress and the second roller remains substantially the same as the second segment of the pallet is raised, preventing substantial movement of the flexible mattress when the second linear motor is actuated to raise the second segment of the pallet.

2. The hospital bed of claim 1, wherein the motor is coupled to the second roller to rotate the second roller.

3. The hospital bed of claim 1, wherein the frame further comprises a locking mechanism for coupling the hospital bed to a movable sanitary station positioned at the foot of the hospital bed.

4. The hospital bed of claim 3, wherein the locking mechanism includes a linear motor for extending and retracting the movable sanitary station away from and toward the foot of the hospital bed.

5. A system for providing sanitation to a non-ambulatory patient, the method comprising:

a hospital bed including a flexible mattress, a belt having a first end attached to the flexible mattress at a foot of the flexible mattress and a second end attached to a head of the flexible mattress, a frame having a pallet for supporting the flexible mattress and having legs extending to the floor, multiple rollers for directing the belt, including a first roller positioned at a first end of the frame corresponding to a foot of the hospital bed for bending the flexible mattress around the first end of the frame, and a second roller positioned at a second end of the frame over which the belt travels when the head of the flexible mattress is moved toward the first end of the frame, whereby the foot of the flexible mattress is guided underneath the pallet and the head of the flexible mattress is moved toward the first end of the frame to transport the patient to the foot of the hospital bed, and a motor for rotating one of the multiple rollers to move the flexible mattress and the belt; and a movable sanitary station including a cabinet having a front side, a back side, a right side, a left side, a bottom, and a top having a toilet seat integrated in a central portion thereof and surrounding a first aperture formed through the top of the cabinet wherein the back side of the cabinet has a concave shape forming a semi-cylindrical cavity having a central axis extending laterally along the back of the cabinet for permitting the flexible mattress to protrude forward into the semi-cylindrical cavity, while permitting the top to extend over the flexible mattress to cover a gap between the foot of the flexible mattress and the back side of the cabinet, wherein the movable sanitary station further includes a set of wheels for supporting and moving the cabinet.

6. The system of claim 5, wherein the hospital bed further comprises a chute attached to the frame and disposed beneath the pallet for receiving the foot of the flexible mattress wherein the first roller directs the flexible mattress downward into the chute.

7. The system of claim 6, wherein the central axis of the semi-cylindrical cavity is aligned substantially with a height of the rotational axis of the first roller.

8. The system of claim 5, wherein the movable sanitary station further includes a pair of leg chutes rotatably coupled to the cabinet near the junction of the top side and the front side of the cabinet for supporting legs of the patient once the patient has been moved atop the toilet seat.

9. The system of claim 8, wherein the leg chutes further include a pair of corresponding knee supports rotatably coupled to the leg chutes near a midpoint of the leg chutes for supporting knees of the patient when the patient has been moved to a cleaning position with a torso of the patient atop the bed and the legs of the patient above the top side of the cabinet, and wherein the knee supports each terminate in a corresponding one of a pair of rollers at ends of the knee supports away from the leg chutes, whereby the rollers of the knee supports can be rolled along a corresponding one of the legs of the patient and locked into position once the roller has reached a back of a knee of the corresponding leg.

10. The system of claim hospital bed of claim 5, wherein the pallet comprises:

a first segment extending from a head of the hospital bed that, when the head of the flexible mattress is positioned at the head of the hospital bed, rotates to raise a back of the patient to a first seated position atop the hospital bed and lowers the back of the patient to a supine position;

a first linear motor for raising and lowering the first segment of the pallet;

a second segment that, when a foot of the flexible mattress is positioned within the chute and the head of the flexible mattress is positioned on the second segment, rotates to raise a back of the patient while the patient is seated on the movable sanitary station positioned at the foot of the hospital bed a second linear motor for raising and lowering the second segment of the pallet; and a control pod for controlling activation of the first linear motor and the second linear motor.

11. The system of claim 10, wherein the control pod includes an activator for activating the first linear motor and the second linear motor to raise both the first segment and the second segment of the pallet in concert, so that a length of extension of the belt between the second end of the belt at the head of the flexible mattress and the second roller remains substantially the same as the second segment of the pallet is raised, preventing substantial movement of the flexible mattress when the second linear motor is actuated to raise the second segment of the pallet.

12. A method of supporting and moving a patient, comprising:

supporting the patient on a flexible mattress;

supporting the flexible mattress on a frame having a pallet that supports the flexible mattress and having legs extending to the floor;

rotating a first segment of the pallet extending from a head of the hospital bed to raise a back of the patient to a first seated position atop the hospital bed, when a head of the flexible mattress is positioned at the head of the hospital bed, by activating a first linear motor for raising and lowering the first segment of the pallet;

rotating a second segment of the pallet when the foot of the flexible mattress is positioned within the chute and the head of the flexible mattress is positioned on the second segment, to raise a back of the patient while the patient is seated on the movable sanitary station positioned at the foot of the hospital bed, by activating a second linear motor for raising and lowering the second segment of the pallet;

operating a control pod coupled to the first linear motor and the second linear motor, wherein the activating the first linear motor and the activating the second linear motor are commenced by actuating a single control of the control pod to raise both the first segment and the second segment of the pallet in concert, so that a length of extension of the belt between the second end of the belt at the head of the flexible mattress and the second roller remains substantially the same as the second segment of the pallet is raised, preventing substantial movement of the flexible mattress when the second linear motor is actuated to raise the second segment of the pallet;

moving the flexible mattress with a belt having a first end attached to the flexible mattress at a foot of the flexible mattress and second end attached to a head of the flexible mattress, by activating a motor that rotates one of a plurality of rollers that guide the belt and the flexible mattress;

bending the flexible mattress over another one of the plurality of rollers positioned at a first end of the frame corresponding to a foot of the hospital bed; and passing the foot of the flexible mattress into a chute attached to the frame and disposed beneath the pallet, whereby the foot of the flexible mattress is guided underneath the pallet and the head of the flexible mattress is moved toward the first end of the frame to transport the patient to the foot of the hospital bed.

13. The method of claim 12, further comprising coupling the hospital bed to a movable sanitary station positioned at the foot of the hospital bed with a locking mechanism attached to the frame.

14. The method of claim 13, further comprising extending and retracting the movable sanitary station away from and toward the foot of the hospital bed by activating a linear motor forming part of the locking mechanism.

* * * * *